US006638177B1

(12) United States Patent
Wang

(10) Patent No.: US 6,638,177 B1
(45) Date of Patent: Oct. 28, 2003

(54) GOLF-BALL CATCHING DEVICE AS ATTACHED ON PUTTER

(76) Inventor: Austin Wang, 3F-1, No. 215, Cheng-Teh Road., Sec. 2, Taipei (TW)

( * ) Notice: Subject to any disclaimer, the term of this patent is extended or adjusted under 35 U.S.C. 154(b) by 0 days.

(21) Appl. No.: 10/154,749

(22) Filed: May 20, 2002

(51) Int. Cl.[7] ..... A63B 57/00; A63B 53/00
(52) U.S. Cl. ..... 473/286; 294/19.2
(58) Field of Search ..... 473/286; 294/19.2, 294/19.3

(56) References Cited

U.S. PATENT DOCUMENTS 1,723,091 A * 8/1929 St. John ..... 294/19.2
5,328,174 A * 7/1994 Reeder ..... 473/239

* cited by examiner

*Primary Examiner*—Stephen Blau

(57) ABSTRACT

A golf-ball catching device includes: an adapter detachably secured on a putter shaft, a fastener formed on the adapter for firmly fastening the adapter on the putter shaft, a chuck with plural pawls and fixed on the adapter, and a clutch member movably held on the chuck; whereby upon disengagement of the clutch member from the chuck to open the pawls of the chuck, the golfer may hold the putter to allow the pawls to be inserted into the hole of a putting green for picking up the golf ball without bending his or her body; and upon engagement of the clutch member with the chuck, the pawls of the chuck may be closed or retracted for a safe ergonomic putting or for a convenient safe storage into a golf bag.

14 Claims, 4 Drawing Sheets

311a
311
311a
310
312
31
3
313
313
32
321
42
43
4
41

11
111
12
121
1
15
12
122
151
11
121
10
2
23
14
22
13
21
S1
S

GOLF-BALL CATCHING DEVICE AS ATTACHED ON PUTTER

BACKGROUND OF THE INVENTION

A conventional ball-catching device as shown in FIG. 7 includes a base C clamped or held on a putter shaft S and a plurality of pawls P for catching a golf ball when rolled into the hole, which however has the following drawbacks:

1. The pawl P has an acute end portion easily injuring the golfer or breaking the golf bag when stored into the bag.
2. The pawls P are divergently formed on the catching device with a fixed form and can not be folded or retracted. The divergent pawls may scratch the golfer's clothes or may influence his or her putting action.
3. The base portion C is formed as a fixed dimension and not suitable for the putters with different sizes.

The present inventor has found the drawbacks of the conventional golf-ball catching device and invented the present catching device with much improvement.

SUMMARY OF THE INVENTION

The object of the present invention is to provide a golf-ball catching device including: an adapter detachably secured on a putter shaft, a fastener formed on the adapter for firmly fastening the adapter on the putter shaft, a chuck with plural pawls and fixed on the adapter, and a clutch member movably held on the chuck; whereby upon disengagement of the clutch member from the chuck to open the pawls of the chuck, the golfer may hold the putter to allow the pawls to be inserted into the hole of a putting green for picking up the golf ball without bending his or her body; and upon engagement of the clutch member with the chuck, the pawls of the chuck may be closed or retracted for a safe ergonomic putting or for a convenient safe storage into a golf bag.

DETAILED DESCRIPTION

Figure 1:
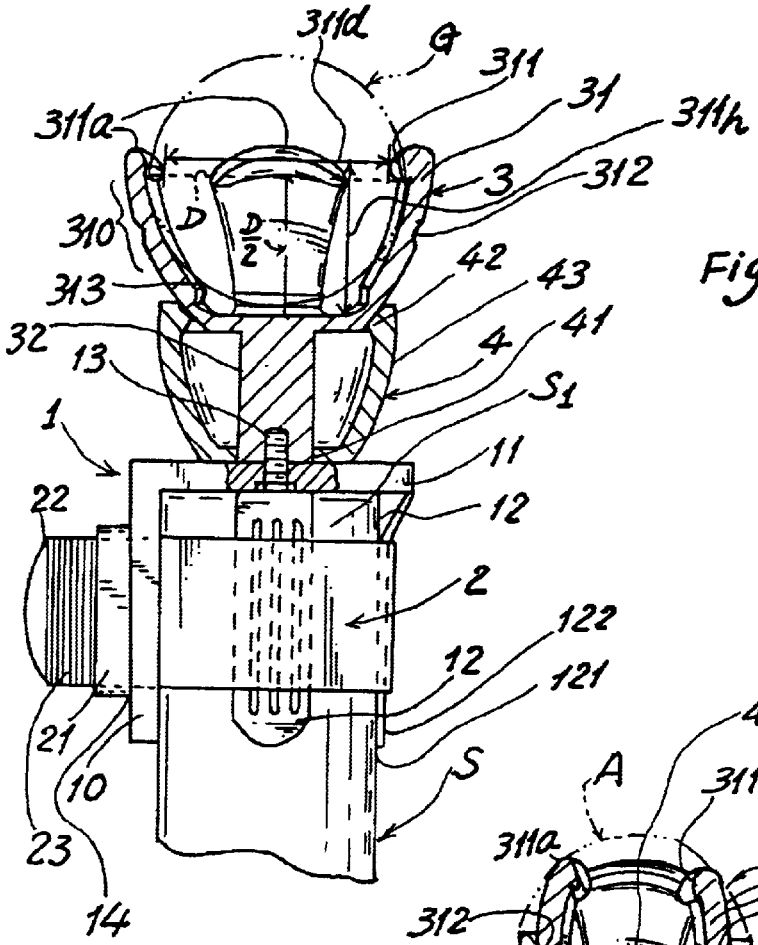
FIG. 1 is a sectional drawing of the present invention for catching a golf ball.
Figure 2:
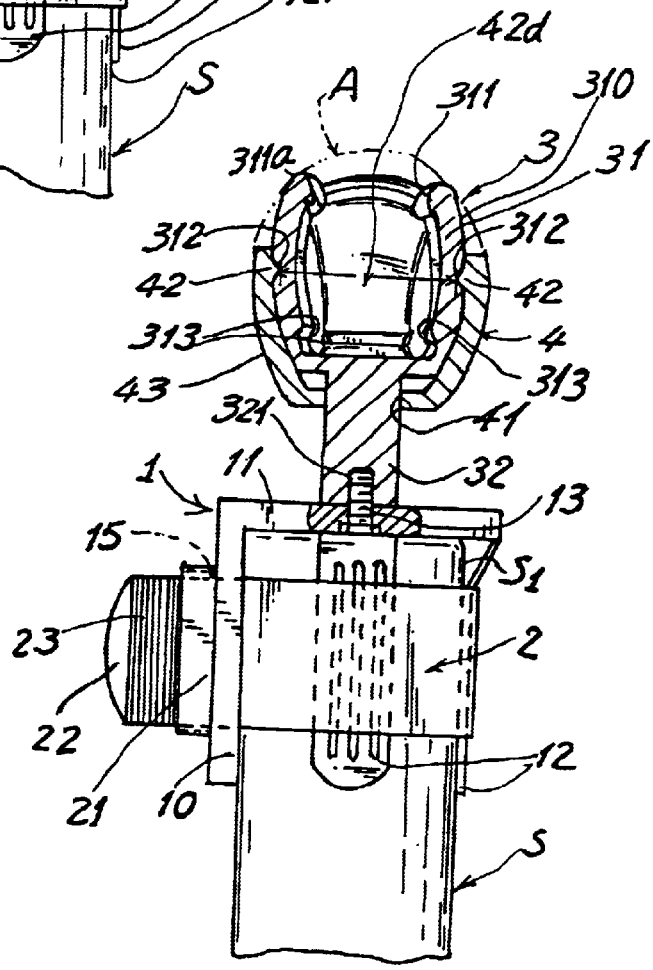
FIG. 2 is a sectional drawing of the present invention when retracting or closing the chuck of the catching device.
Figure 3:
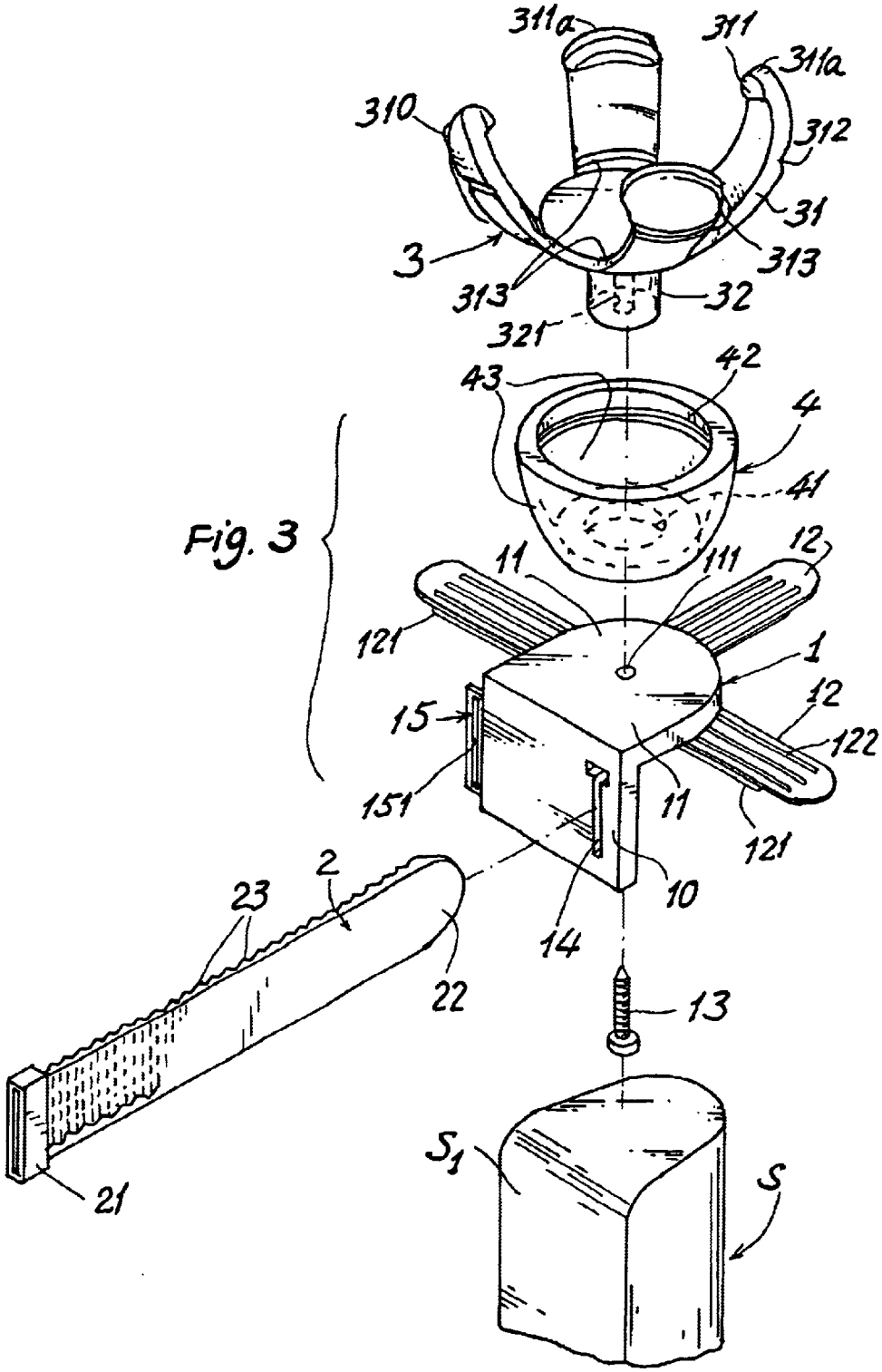
FIG. 3 is an exploded view showing the elements of the present invention.

As shown in FIGS. 1~3, the present invention comprises: an adapter 1, a fastener 2, a chuck 3 and a clutch member 4.

The adapter 1 may be detachably (or fixedly) mounted on a putter shaft S especially on a top end portion S1 of the putter shaft S. The embodiments as shown in the drawing figures are illustrated for describing the present invention only, not for limiting the present invention to the specific structures as such illustrated.

The adapter 1 includes: a base 11 having a plurality of fastening leaves 12 foldably formed on the base 11 and having a screw hole 111 formed through the base 11 for securing the chuck 3 on the base 11 by a screw 13 passing through the screw hole 111 and locked into a screw hole 321 formed in the chuck 3; and a side wall 10 integrally formed on or protruding from the base 11 for securing the fastener 2 on the side wall 10; whereby upon grasping of the fastening leaves 12 around a top portion S1 of the putter shaft S and upon fastening of the fastener 2 to surround the leaves 12 on the shaft S, the adapter 1 and the golf-ball catching device of the present invention will be firmly fastened on the shaft S.

Each fastening leaf 12 is formed with a plurality of longitudinal teeth 122 on an outer surface of each leaf to be frictionally engaged with a plurality of vertical teeth 23 juxtapositionally formed on the fastener 2 when each fastening leaf 12 is folded downwardly to be disposed about the putter shaft S, thereby fastening the leaves 12 around the shaft S by the fastener 2.

The fastener 2 may be formed as an elongate strip having a fixed end portion 21 engaged or fixed on a first fixing portion 14 formed on the side wall 10 of the adapter 1 and a free end portion 22 fastened to a second fixing portion 15 formed on the side wall 10 opposite to the first fixing portion 14 after firmly surrounding and fastening the fastening leaves 12 on the shaft S.

The second fixing portion 15 on the side wall 10 of adapter 1 may be formed as an engaging slot 151 to be engaged or locked with the vertical tooth 23 formed on the fastener 2 for locking the free end portion 22 of the fastener 2 on the adapter 1.

Each fastening leaf 12 may be formed with a frictional packing pad 121 on an inner surface of each leaf for frictionally holding the leaf 12 on the shaft 3 as fastened by the fastener 2.

Figure 4:
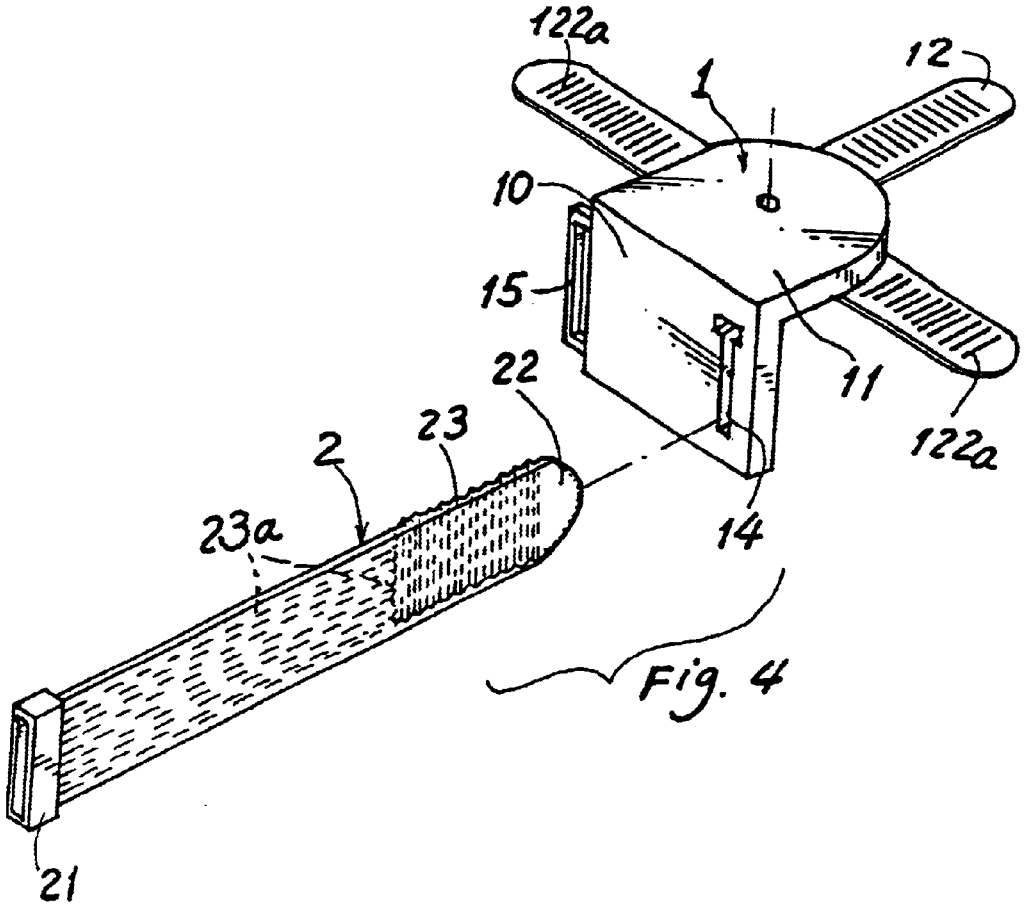
FIG. 4 shows another preferred adapter and fastener of the catching device of the present invention.

The fastener 2 as shown in FIG. 4 is modified to have horizontal teeth 23*a* horizontally formed on the fastener 2 in order to be engaged with a plurality of latitudinal teeth 122*a* juxtapositionally formed on each leaf 12.

Figure 5:
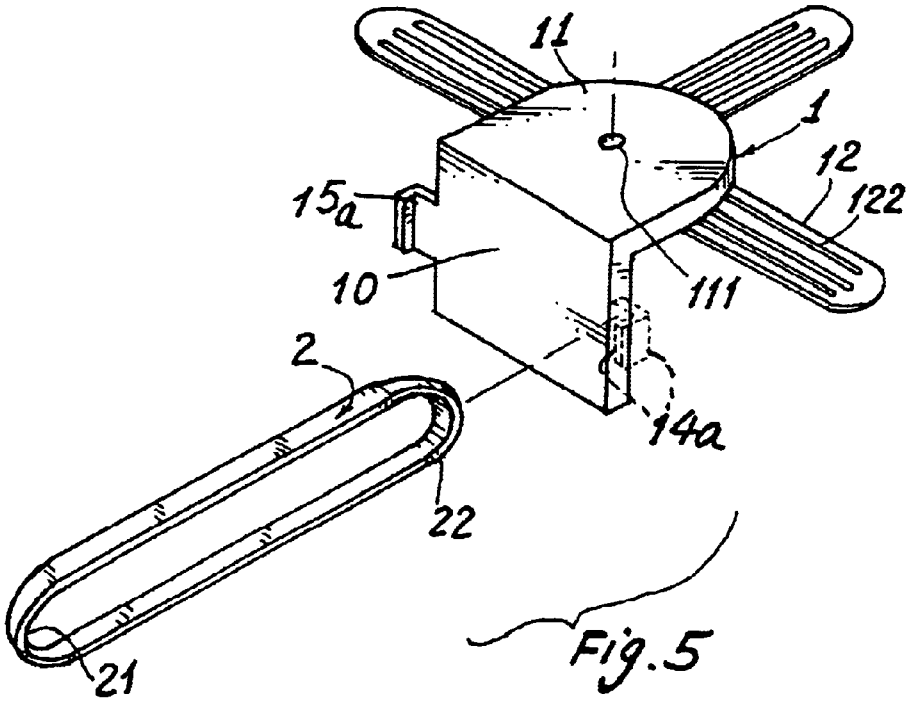
FIG. 5 shows still another modification of the adapter and the fastener of the catching device.

The fastener 2 as shown in FIG. 5 has been modified to be an elastic ring or strip to be fastened on opposite brackets 14*a*, 15*a* respectively formed on opposite ends of the side wall 10 of the adapter 1. Naturally, the two brackets 14*a*, 15*a* may be further simplified to be a single bracket (not shown), on which the two loop ends 21, 22 of the elastic ring (strip) 2 are tied or fastened to the single bracket.

Figure 6:
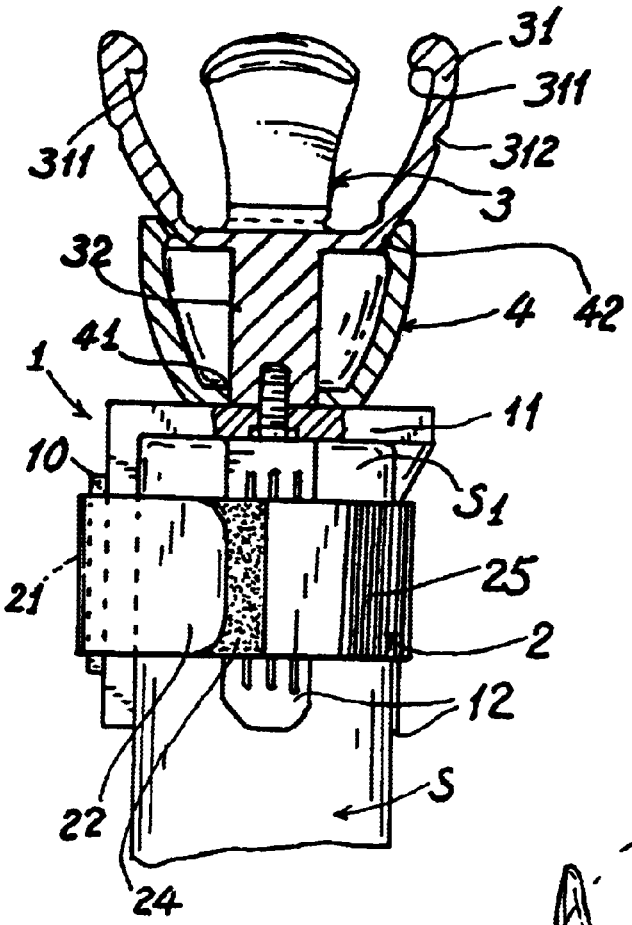
FIG. 6 shows further modification of the fastener and the adapter of the catching device of the present invention.
Figure 7:
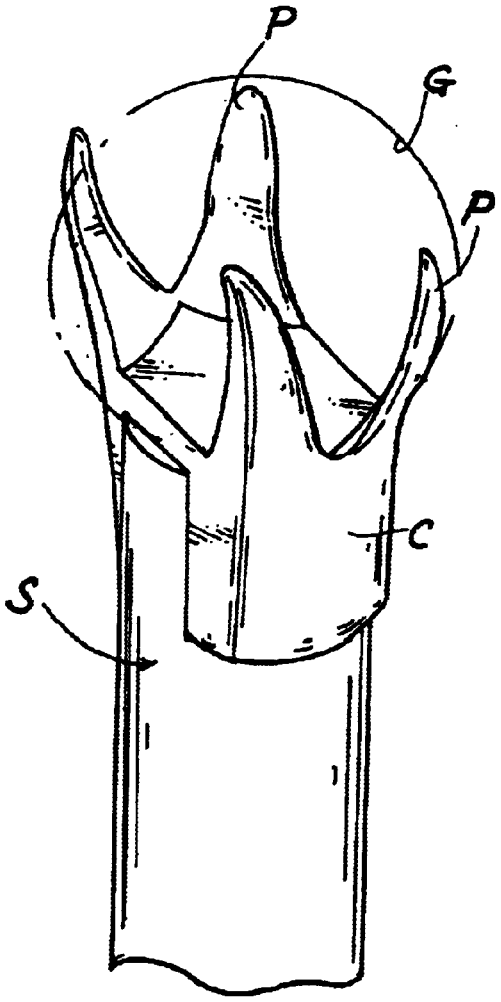
PRIOR ART Fig. 7
FIG. 7 shows a conventional golf-ball catching device.

Or, the fastener 2 may be modified to be a fastening strip as shown in FIG. 6 having an elastic fastener portion (made of rubber and other elastic materials) 25 formed on the fastener 2; and having a coarse surface of a Velcro tape 24 formed on one end of the fastener 2 coupled with tiny hooked threads of the Velcro tape 24 formed on the other end of the fastener for fastening the fastener 2 for firmly fastening the leaves 12 on the shaft S.

The fastener 2 and the adapter 1 may be further modified to be a plurality of preferred embodiments for firmly fastening the catching device of the present invention on the shaft S, not limited in this invention.

Since the plurality of fastening leaves 12 are foldably secured to the base 11 of the adapter, the leaves 12 may be manipulated to grasp the putting shaft S even having different sizes. So, the present invention may be adapted for differently sized putting shafts.

The chuck 3 includes: a plurality of pawls 31 normally resiliently diverging flaredly (FIG. 1) for catching a golf ball G from a hole in a putting green; and a shank portion 32 having its lower portion secured to the base 11 of the adapter 1 such as fixed by a screw 13 and having the pawls 31 formed on an upper portion of the shank portion 32; with the pawls 31 operatively retracted centripetally to be closed for forming an elliptical (or spherical or arcuate) contour A (FIG. 2) for a safe ergonomic putting or for a safe convenient storage in a golf bag (not shown).

Each pawl 31 includes: a hook portion 311 formed on an outer end portion of the pawl 31 and having an arcuate top surface 311*a* for a smooth safe putting or safe storage of the present invention, a groove 312 recessed in a middle (or outer) portion of the pawl 31 to be engaged with an outer ring 42 of the clutch member 4 when the pawls 31 are closed as shown in FIG. 2, and a thin root portion 313 formed on an inner portion of the pawl 31 adjacent to the shank portion 32 for providing the resilience of each pawl 31 as biased on the thin root portion 313 (serving as a "fulcrum" of the lever-like pawl 31), the pawl 31 having an arcuate side surface 310 for smoothly engaging with or disengaging from the clutch member 4 and also for forming a smooth arcuate surface for a safe putting or storage of the catching device.

The clutch member 4 includes: an inner ring defining a central hole 41 to be slidably engageable with the shank portion 32 of the chuck 3, and an outer ring 42 formed on an outer periphery of a sleeve portion 43 generally bowl-shaped, or cup-shaped, or conical shape disposed about the shank portion 32 of the chuck 3; with the outer ring 42 operatively engaged with each groove 312 recessed in each pawl 31 (FIG. 2) for retracting or closing the pawl 31 for forming an elliptical (or arcuate) contour A generally confined by the arcuate surfaces 310 of the pawl 31, the bowl-shaped sleeve portion 43 of the clutch member 4 for a safe ergonomic putting or safe convenient storage of the catching device attached on the putter shaft S.

When catching the golf ball G, the pawls 31 of the chuck 3 have the plurality of hook portions 311 concentrically defining a circle having an inside diameter 311*d* slightly smaller than a diameter of the golf ball G as shown in FIG. 1 and having a height 311*h* of the hook portion 311 of each pawl 31 above the shank portion 32 being larger than a radius (½ diameter) of the golf ball (FIG. 1) in order to limit the ball G within the pawls 31 to prevent from releasing of the ball G from the chuck 3.

The outer ring 42 of the clutch member 4 defines an inside diameter 42*d* (FIG. 2), generally ranging from one half (½) through two third (⅔) of the diameter of the golf ball G; and the inside diameter 42*d* of the outer ring 42 being smaller than the inside diameter 311*d* of the hook portions 311 of the pawls 31 (when normally diverged flaredly) so that the pawls 31 of the chuck 3 will be centripetally retracted for safe ergonomic putting or storage of the present invention.

Otherwise, if the diameter 42*d* of the outer ring 42 were too large (e.g. approximating the diameter of the ball G), the pawls 31, as grasped by the clutch member 4, will not be greatly retracted or closed, still diverging the pawls 31 outwardly flaredly to possibly influence a putting action or to injure the player.

The elements of the present invention may be made of elastomers including plastics. But the materials as used are not limited in this invention.

For catching or picking up golf ball from a green hole, the pawls 31 are pushed to the ball G to slidably engage the ball within the pawls 31 after holding the putter shaft S by inverting the club of the putter upwardly. The ball G is resiliently held by the pawls 31 and can be easily released from the pawls 31 after opening the pawls.

For putting action or for storage of the putter into a golf bag, the clutch member 4 is pushed upwardly from FIG. 1 to FIG. 2 to engage the outer ring 42 with the grooves 312 of the pawls 31. Since the pawls 31 are flared outwardly having an inside diameter 311*d* within the hook portions 311 of the pawls 31 being larger than an inside diameter 42*d* of the outer ring 42, the pawls 31 will be gradually retracted as converged by the outer ring 42 of the clutch member 4 to generally define an arcuate contour A (FIG. 2) of the retracted pawls and the clutch member for a safe ergonomic putting without injuring the player, or without influencing the player's putting action and also for a safe convenient storage of the present invention as attached on the putter to be stored into a bag.

Accordingly, the present invention provides a golf-ball catching device for catching a golf ball, which can be operated to retract the pawls of the catching device for a safe ergonomic putting or for a safe convenient storage thereof and which can be suitable for differently-sized putters. Namely, the present invention is adjustable for the putters of different sizes.

The present invention may be modified without departing from the spirit and scope of the present invention.

I claim:

1. A golf-ball catching device comprising: an adapter detachably secured on a putter shaft and including: a base having a plurality of fastening leaves foldably formed on the base, and a side wall integrally formed on the base for securing a fastener on the side wall, whereby upon grasping of the fastening leaves around a top portion of the putter shaft and upon fastening of the fastener to surround the fastening leaves on the shaft, the adapter of the golf-ball catching device will be firmly fastened on the shaft; a chuck fixed on the base of the adapter; and a clutch member movably held on the chuck; whereby upon disengagement of the clutch member from the chuck to open the chuck, the chuck will be inserted into a hole of a putting green for picking up a golf ball in the hole; and upon engagement of the clutch member with the chuck, the chuck will be closed for a safe ergonomic putting and for a convenient safe storage of the catching device.

2. A golf-ball catching device according to claim 1, wherein each said fastening leaf is formed with a plurality of longitudinal teeth on an outer surface of each said leaf to be frictionally engaged with a plurality of vertical teeth juxtapositionally formed on the fastener 2 when each said fastening leaf is folded downwardly to be disposed about the putter shaft for fastening the leaves around the shaft by the fastener.

3. A golf-ball catching device according to claim 1, wherein said fastener is formed as an elongate strip having a fixed end portion fixed on a first fixing portion formed on the side wall of the adapter and a free end portion fastened to a second fixing portion formed on the side wall opposite to the first fixing portion after surrounding and fastening the fastening leaves on the shaft.

4. A golf-ball catching device according to claim 3, wherein said second fixing portion on the side wall of adapter is formed as an engaging slot to be engaged with a vertical tooth formed on the fastener for locking the free end portion of the fastener on the adapter.

5. A golf-ball catching device according to claim 4, wherein said fastener includes a plurality of horizontal teeth horizontally formed on the fastener to be engaged with a plurality of latitudinal teeth juxtapositionally formed on each said leaf.

6. A golf-ball catching device according to claim 1, wherein each said fastening leaf is formed with a frictional packing pad on an inner surface of each said leaf for frictionally holding the leaf on the shaft as fastened by the fastener.

7. A golf-ball catching device according to claim 1, wherein said fastener includes: an elastic ring fastened on at least a bracket formed on the side wall of the adapter.

8. A golf-ball catching device according to claim 1, wherein said fastener is formed as a fastening strip having an elastic fastener portion formed on the fastener; and having a coarse surface of a Velcro tape formed on a first end of the fastener coupled with tiny hooked threads of the Velcro tape formed on a second end of the fastener for fastening the fastener for firmly fastening the leaves on the shaft.

9. A golf-ball catching device according to claim 1, wherein said chuck includes: a plurality of pawls normally resiliently diverging flaredly for catching a golf ball from a hole in a putting green; and a shank portion having its lower portion secured to a base of the adapter and having the pawls formed on an upper portion of the shank portion; with the pawls operatively retracted centripetally by said clutch member to be closed for forming an arcuate contour for a safe ergonomic putting or for a safe convenient storage thereof in a golf bag.

10. A golf-ball catching device according to claim 9, wherein each said pawl of said chuck includes: a hook portion formed on an outer end portion of the pawl and having an arcuate top surface on the hook portion, and a groove recessed in the pawl to be engaged with an outer ring of the clutch member when the pawls are closed.

11. A golf-ball catching device according to claim 10, wherein each said pawl includes a thin root portion formed on the pawl adjacent to a shank portion of said chuck.

12. A golf-ball catching device according to claim 11, wherein said chuck includes a plurality of said hook portions of said pawls concentrically defining a circle having an inside diameter slightly smaller than a diameter of the golf ball and having a height of the hook portion of each said pawl above the shank portion being larger than a radius of the golf ball in order to limit the ball within the pawls to prevent from releasing of the ball from the chuck.

13. A golf-ball catching device according to claim 10, wherein said clutch member includes: an inner ring defining a central hole to be slidably engageable with the shank portion of the chuck, and an outer ring formed on an outer periphery of a sleeve portion generally bowl-shaped and disposed about the shank portion of the chuck; with the outer ring operatively engaged with a groove recessed in each said pawl for retracting or closing the pawl for forming an arcuate contour generally confined by an arcuate surface of the pawl and of the sleeve portion of the clutch member for a safe ergonomic putting or safe convenient storage of the catching device attached on the putter shaft.

14. A golf-ball catching device according to claim 13, wherein said outer ring of said clutch member defines an inside diameter generally ranging from one half through two third of the diameter of the golf ball, and an inside diameter of the outer ring being smaller than an inside diameter of a circle concentrically defined by a plurality of hook portions of the pawls when normally diverged flaredly.

* * * * *